US008199884B2

(12) United States Patent
Junjie et al.

(10) Patent No.: US 8,199,884 B2
(45) Date of Patent: Jun. 12, 2012

(54) SLIT MECHANISM APPARATUS AND X-RAY COMPUTED TOMOGRAPHY APPARATUS

(75) Inventors: Sun Junjie, Dalian (CN); Zhang Jingjing, Dalian (CN); Wei He, Dalian (CN)

(73) Assignees: Kabushiki Kaisha Toshiba, Tokyo (JP); Toshiba Medical Systems Corporation, Otawara-shi (JP)

( * ) Notice: Subject to any disclaimer, the term of this patent is extended or adjusted under 35 U.S.C. 154(b) by 200 days.

(21) Appl. No.: 12/762,693

(22) Filed: Apr. 19, 2010

(65) Prior Publication Data

US 2011/0038466 A1 Feb. 17, 2011

(30) Foreign Application Priority Data

Aug. 12, 2009 (CN) ..... 2009 1 0165898
Feb. 25, 2010 (JP) ..... 2010-040550

(51) Int. Cl.
*G21K 1/04* (2006.01)

(52) U.S. Cl. ..... 378/160; 378/150

(58) Field of Classification Search ..... 378/4–20, 378/145–153, 160
See application file for complete search history.

(56) References Cited

U.S. PATENT DOCUMENTS 6,445,764 B2 * 9/2002 Gohno et al. ..... 378/19
6,707,876 B2 * 3/2004 Tanigawa ..... 378/19

* cited by examiner

*Primary Examiner* — Courtney Thomas
(74) *Attorney, Agent, or Firm* — Oblon, Spivak, McClelland, Maier & Neustadt, L.L.P.

(57) ABSTRACT

According to one embodiment, a slit mechanism apparatus includes, two slit plates configured to adjust a thickness of X-rays, two slit link bars which are pivotally supported on two ends of each of the two slit plates to interlock the two slit plates, two shafts on which the two slit link bars are respectively mounted to rotate the two slit link bars, two shutter plates configured to block/pass the X-rays, and two shutter link bars which are pivotally supported on two ends of each of the two shutter plates to interlock the two shutter plates and are mounted on the two shafts together with the two slit link bars.

23 Claims, 6 Drawing Sheets

SLIT MECHANISM APPARATUS AND X-RAY COMPUTED TOMOGRAPHY APPARATUS

CROSS-REFERENCE TO RELATED APPLICATIONS

This application is based upon and claims the benefit of priority from Chinese Patent Application No. 200910165898.7, filed Aug. 12, 2009; and Japanese Patent Application No. 2010-040550, filed Feb. 25, 2010, the entire contents of both of which are incorporated herein by reference.

FIELD

Embodiments described herein relate generally to a slit mechanism apparatus for an X-ray computed tomography apparatus (CT apparatus).

BACKGROUND

A CT apparatus is a medical diagnosis apparatus to diagnose a patient with X-rays. As shown in FIG. 1, the CT apparatus includes an X-ray tube 10 which emits X-rays, a slit mechanism (optical adjustment means) 11*a* to adjust the width of X-rays, a bed 12 on which a patient is placed, and a detection unit 13 to detect X-rays and perform signal processing.

In general, before diagnosis using a CT apparatus, it is necessary to preheat the X-ray tube 10 to emit X-rays. During a preheat period, it is necessary to block unnecessary X-rays by using a shutter plate (X-ray blocking mechanism).

A shutter plate 11*c* is mounted in the optical system unit 11. The shutter mechanism 11*c* has a shutter plate, e.g., a lead plate, with an X-ray blocking function placed in the path of X-rays so as to implement X-ray blocking operation.

In addition, when the X-ray tube normally emits X-rays, no X-rays are blocked. At this time, the shutter plate to block X-rays moves away from the path of X-rays.

As shown in FIG. 2, the optical system unit 11 of the conventional CT apparatus includes wedge mechanisms 11*a* to filter X-rays, a slit mechanism 11*b* to adjust the width of X-rays, and the shutter plate 11*c*. The slit mechanism can have a plurality of types of wedges. Different types of wedges are applied to different types of diagnosis. Each wedge and the shutter plate share the same driving mechanism. A wedge and the shutter plate are moved by driving the driving mechanism to switch between different types of wedges and the shutter plates.

The conventional shutter mechanism is integrated with a wedge mechanism, and uses the driving mechanism to drive the shutter plate so as to move it to the path of X-rays along a linear rail. That is, the shutter mechanism has a complicated structure. As shown in FIG. 3, in particular, when a shutter mechanism includes only one wedge and need not control its movement, it is also necessary to the wedge mechanism driving and moving the wedge to implement switching between X-ray blockage and normal X-ray emission, resulting in increases in the amount of unwanted structure and cost.

DETAILED DESCRIPTION

In general, according to one embodiment, an a slit mechanism apparatus comprising:

two slit plates configured to adjust a thickness of X-rays;

two slit link bars which are pivotally supported on two ends of each of the two slit plates to interlock the two slit plates;

two shafts on which the two slit link bars are respectively mounted to rotate the two slit link bars;

two shutter plates configured to block/pass the X-rays; and two shutter link bars which are pivotally supported on two ends of each of the two shutter plates to interlock the two shutter plates and are mounted on the two shafts together with the two slit link bars.

Figure 1:
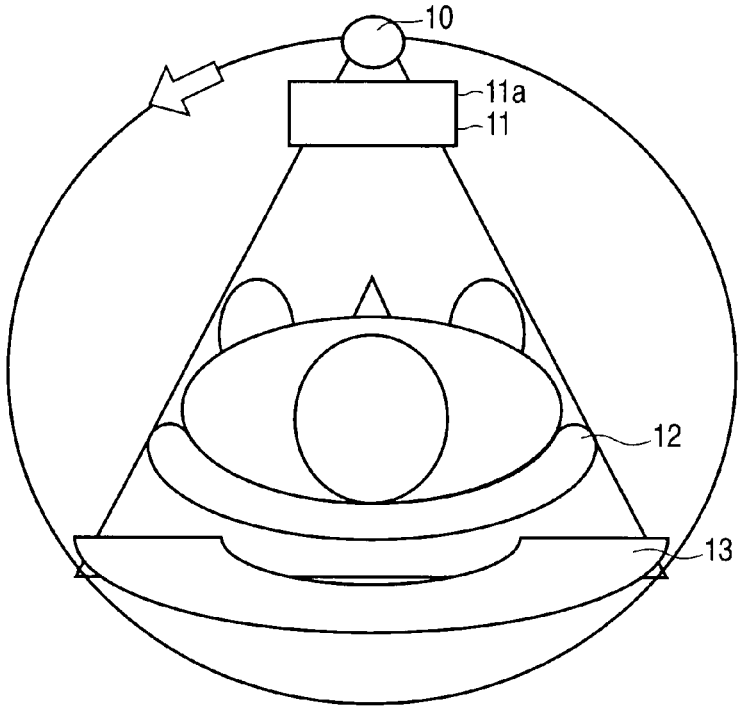
FIG. 1 is a schematic view showing the structure of a CT apparatus.
Figure 2:
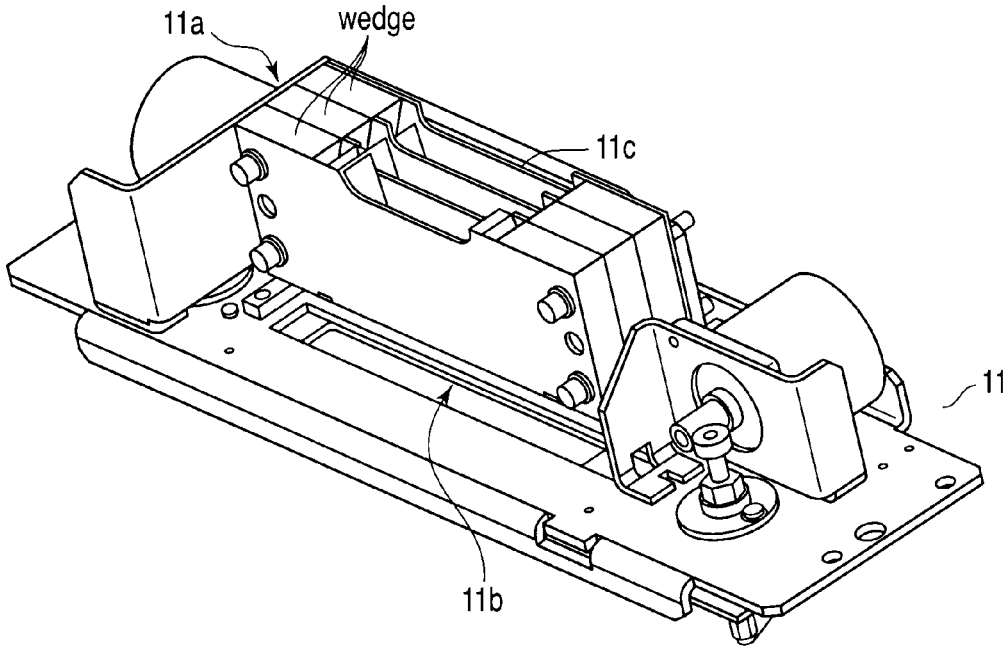
FIG. 2 is a schematic view showing the structure of a wedge mechanism and a slit mechanism in a conventional CT apparatus.
Figure 3:
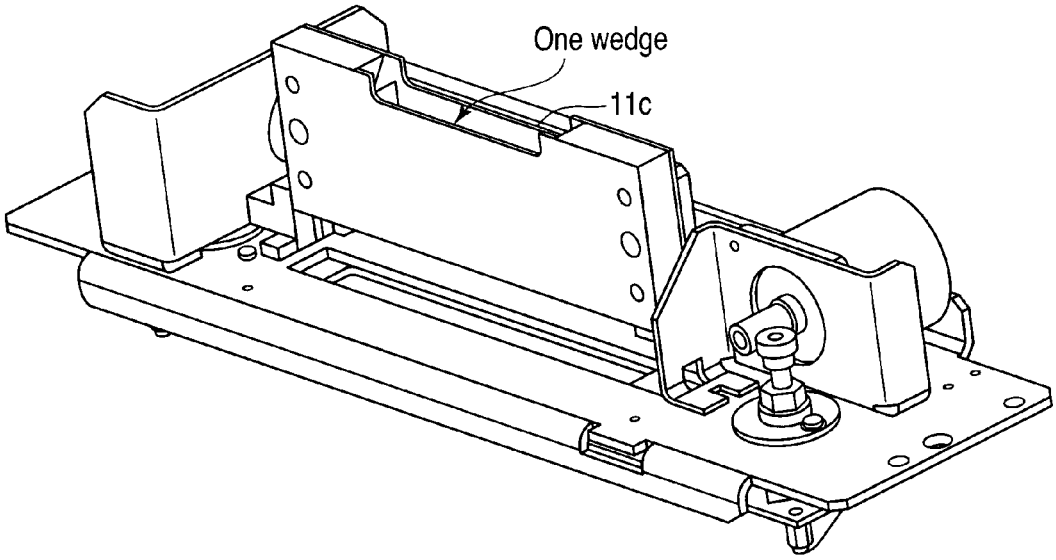
FIG. 3 is a schematic view showing a conventional wedge plate.
Figure 4:
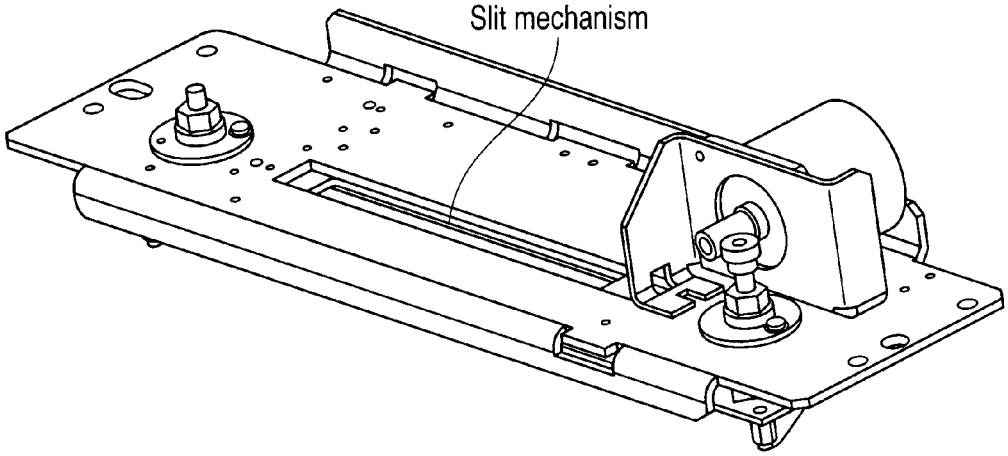
FIG. 4 is a perspective view of the slit mechanism of a CT apparatus according to this embodiment.

FIG. 4 is a perspective view of the slit mechanism of a CT apparatus according to this embodiment. In the embodiment, a slit mechanism and a shutter mechanism share an opening/closing mechanism and a driving mechanism.

Figure 5:
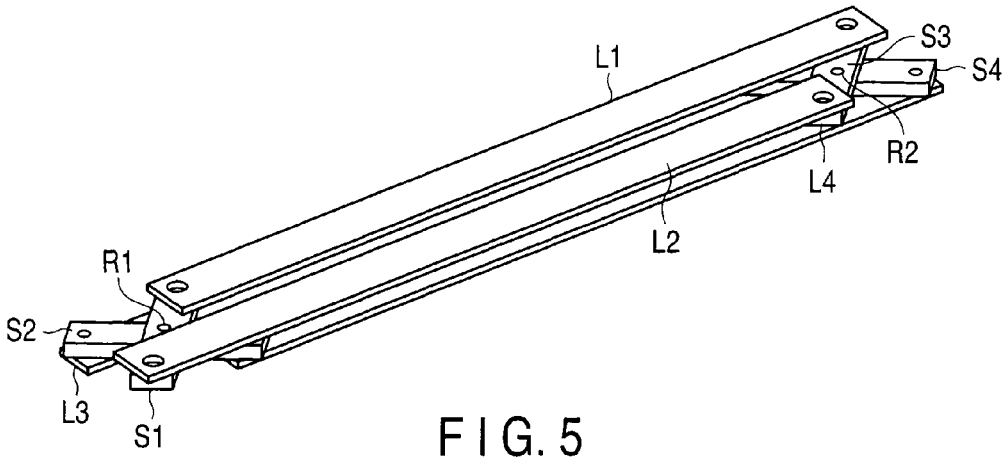
FIG. 5 is a perspective view of the slit mechanism according to this embodiment.

FIG. 5 is a perspective view of the slit mechanism according to this embodiment.

Figure 6:
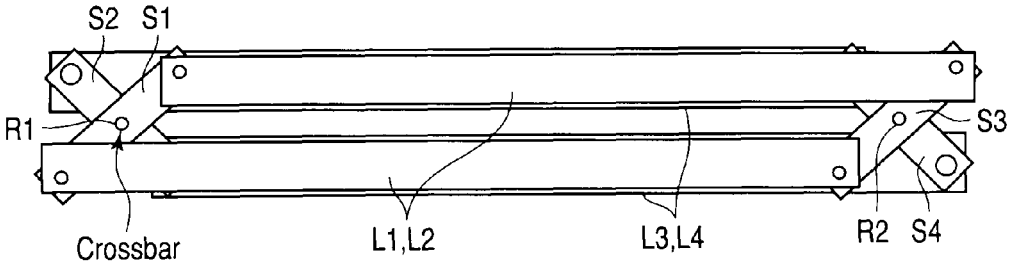
FIG. 6 is a front view of the slit mechanism according to this embodiment.

FIG. 6 is a front view of the slit mechanism according to the embodiment. The slit mechanism according to this embodiment includes a slit function of adjusting the width of X-rays and a shutter function of blocking X-rays. The slit mechanism of this embodiment includes a shutter mechanism. The slit mechanism includes two slit plates (X-ray width adjustment plates) L3 and L4 having the same length and width. The slit plates L3 and L4 are coupled to each other at their two ends through two link bars S2 and S4 having the same length. The link bars S2 and S4 are mounted on two shafts R1 and R2 which interlock and rotate. Rotating the two shafts R1 and R2 makes the slit plates L3 and L4 approach/separate while maintaining their parallel state. This changes the width of the slit between the slit plates L3 and L4. As the width of the slit changes, the width of X-rays changes.

It is not necessary to provide it by a integral structure with shutter link bar S1 and slit link bar S2. It may be provided by a separate structure with shutter link bar S1 and slit link bar S2. It may be similarly provided by a integral structure with shutter link bar S3 and slit link bar S4.

Two shutter plates L1 and L2 are coupled to each other at their two ends through two link bars S1 and S3 having the same length. The link bars S1 and S3 are mounted on the two shafts (common shafts) R1 and R2 on which the link bars S2 and S4 of the slit plates L3 and L4 are mounted, together with the link bars S2 and S4. The link bars S1 and S3 are mounted on the shafts R1 and R2 at a predetermined distance from the link bars S2 and S4 so as to prevent the slit plates L3 and L4 from interfering with the shutter plates L1 and L2. Rotating the two shafts R1 and R2 will open/close the slit between the shutter plates L1 and L2 while maintaining their parallel state. This blocks/passes X-rays.

The shutter link bars S1 and S3 intersect the slit link bars S2 and S4 at the angle selected from the range of 50°-140°, for instance, 90° respectively. This forms two crossbars (switching means). When the slit plates L3 and L4 separate from each other as the two shafts R1 and R2 rotate clockwise, the shutter plates L1 and L2 approach each other and completely close the slit in the end. When the shutter plates L1 and L2 separate from each other as the two shafts R1 and R2 rotate counterclockwise, the slit plates L3 and L4 approach each other.

The two ends of each of the two shutter link bars S1 and S3 are pivotally connected to the two ends of a corresponding one of the two shutter plates L1 and L2 with, for example, screws to form a parallelogram. The two ends of each of the two slit link bars S2 and S4 are pivotally connected to the two ends of a corresponding one of the two slit plates L3 and L4 with, for example, screws to form another parallelogram.

The shutter link bar S1 intersects the slit link bar S2 at a predetermined angle to form one "crossbar". The shutter link bar S3 intersects the slit link bar S4 at a predetermined angle to form the other "crossbar". Fixing intersecting points by the shafts R1 and R2 allows the shutter link bar S1, the slit link bar S2, the shutter link bar S3, and the slit link bar S4 to rotate about the common shafts R1 and R2 at the intersecting points. When the shutter link bar S1, the slit link bar S2, the shutter link bar S3, and the slit link bar S4 rotate about the shafts R1 and R2 at the intersecting points, the long sides of the two parallelograms move in the opposite directions.

By determining in advance the length relationship between the shutter link bar S1 and the slit link bar S2, the length relationship between the shutter link bar S3 and the slit link bar S4, and the angle relationship between the intersections of the crossbars, it is possible to link the slit mechanism with the shutter mechanism so as not to interfere with each other. In this case, the length of the shutter link bar S1 is equal to that of the shutter link bar S3. The length of the slit link bar S2 is equal to that of the slit link bar S4.

The length relationship between the shutter link bar S1 and the slit link bar S2 and the length relationship between the shutter link bar S3 and the slit link bar S4 have been embodied, but this embodiment is not limited to the above relationships.

Figure 7:
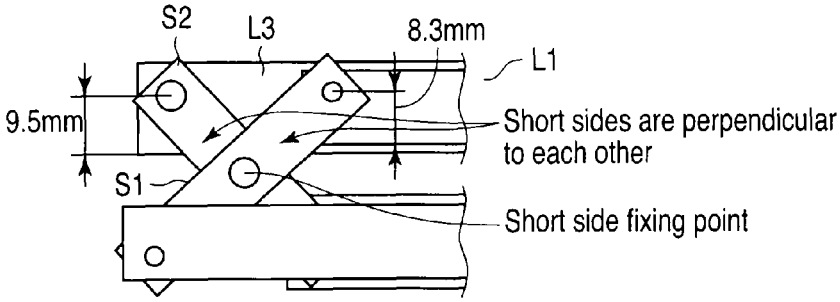
FIG. 7 is a schematic view showing the length relationship between a shutter plate and a shutter link bar according to this embodiment.

In this embodiment, for example, the length of the shutter link bars S1 and S3 is set to 39 mm, the length of the slit link bars S2 and S4 is set to 35 mm, and the intersection angle of the crossbars is set to 90°. FIG. 7 further shows a case in which the distance from a side of the shutter plate L1 to the pivotal contact between the shutter plate L1 and the shutter link bar S1 is set to 8.3 mm, and the distance from a side of the slit plate L3 to the pivotal contact between the slit plate L3 and the slit link bar S2 is set to 9.5 mm.

Figure 8A:
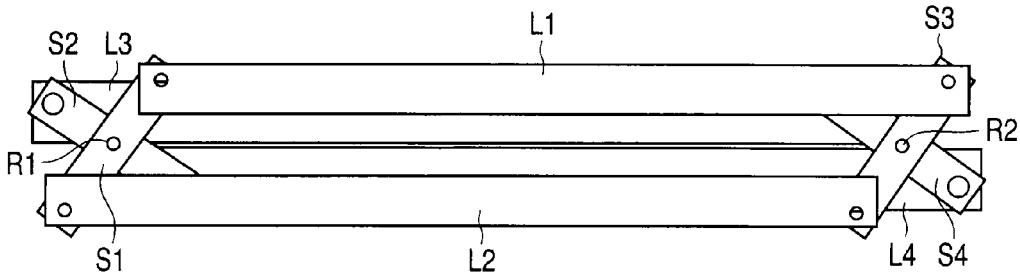
FIGS. 8A, 8B and 8C show conceptual views of an operation process of the slit mechanism according to this embodiment.
Figure 8B:
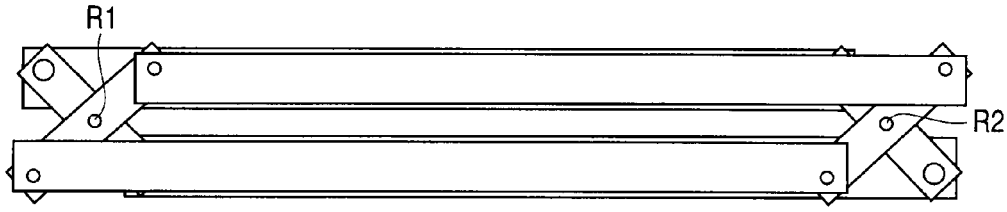
Figure 8C:
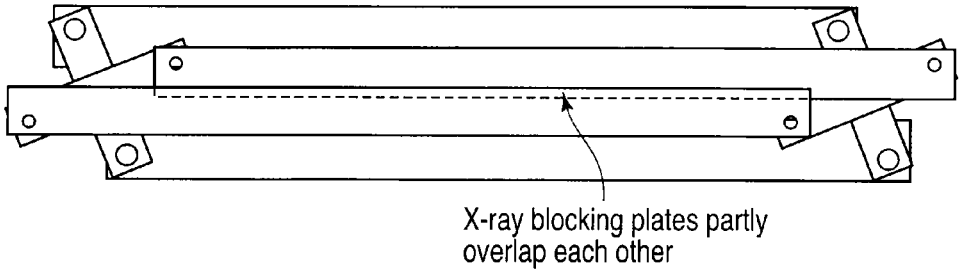

FIGS. 8A-8C show conceptual views of an operation process of the slit mechanism according to this embodiment. FIGS. 8A, 8B show process changes in which the slit width of the slit mechanism changes from small to large when the shutter mechanism does not block X-rays. In this process, the slit of the shutter mechanism which passes X-rays is always larger than that of the slit mechanism which passes X-rays. This setting inhibits the shutter mechanism from interfering with the adjustment of a width of X-rays by the slit mechanism. In order to meet this requirement, the length of the shutter link bars S1 and S3 needs to be equal to or more than that of the slit link bars S2 and S4. According to the machine type of this embodiment, the range of slit width adjustment by the slit mechanism is 1 mm to 6.7 mm.

FIG. 8C shows a conceptual view when the shutter mechanism blocks X-rays. When blocking X-rays, the two shutter plates of the shutter mechanism partly overlap each other to completely block the path of X-rays.

Figure 9A:
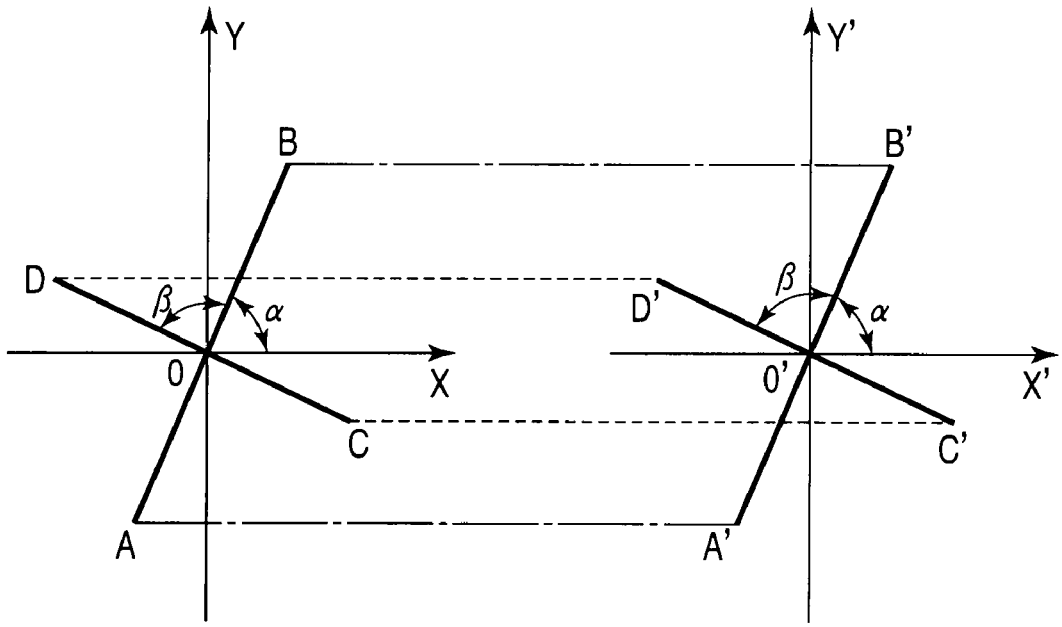
FIGS. 9A and 9B show conceptual views of the angle relationship between shutter link bars and slit link bars according to this embodiment.
Figure 9B:
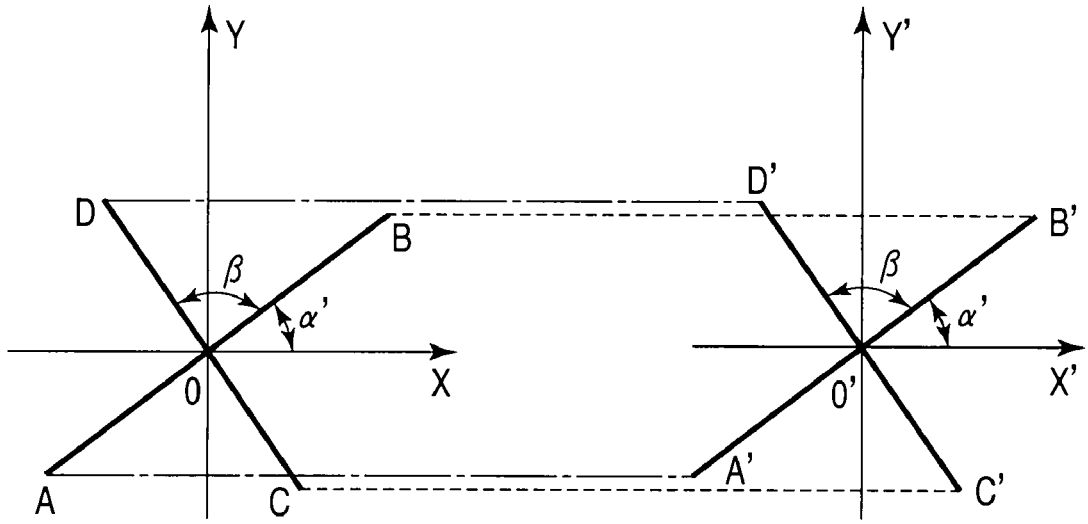

FIGS. 9A and 9B show conceptual views showing the angle relationships between the shutter link bar S1 and the slit link bar S2 and between the shutter link bar S3 and the slit link bar S4, and in FIG. 9B shows the angle relationship after the angles in FIG. 9A are rotated clockwise.

As shown in FIGS. 9A and 9B, reference symbols A, B, A', and B' denote the four end points of the shutter link bars S1 and S3; and C, D, C', and D', the four end points of the slit link bars S2 and S4. The left and right structures are completely the same, and the eight points A, B, C, D, A', B', C', and D' have in-plane rotation degrees of freedom.

L(AB) and L(CD) intersect each other at a point O and are fixed to form a "crossbar", and the angle defined by the two sides is represented by β. L(A'B') and L(C'D') intersect each other at a point O' and are fixed to form a "crossbar", and the angle defined by the two sides is represented by β.

A parallelogram ABB'A' can rotate about O and O', with two long sides being denoted by reference symbols AA' and BB'. A parallelogram CDD'C' can rotate about O and O', with two long sides being denoted by reference symbols CC' and DD'.

When the two "crossbars" rotate about O and O' clockwise, the distance between AA' and BB' decreases, as shown in (b) of FIG. 9. This amount of change is given by $\Delta L(AB)=L(AB)*(\mathrm{SIN}\ \alpha-\mathrm{SIN}\ \alpha')$. The distance between CC' and DD' increases. This amount of change is given by $\Delta L(CD)=L(CD)*\{\mathrm{SIN}(\alpha'+\beta)-\mathrm{SIN}(\alpha+\beta)\}$.

Figure 10:
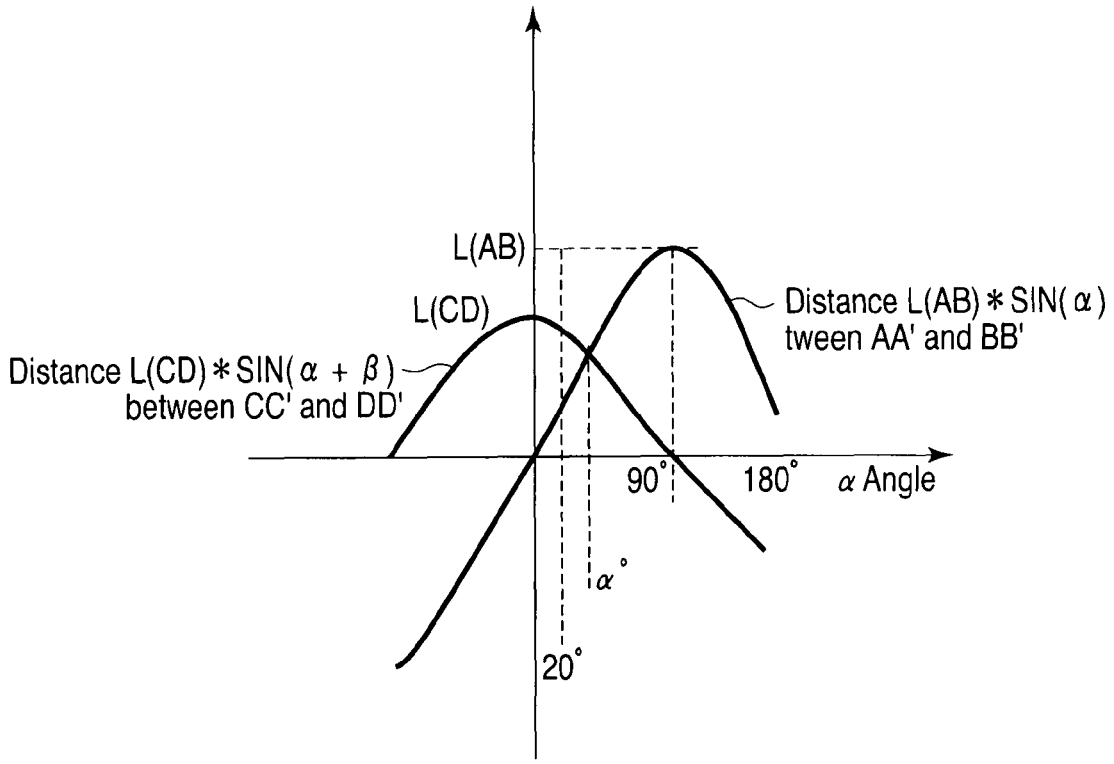
FIG. 10 is a conceptual view showing changes in the angle-length relationship between the shutter link bars and the slit link bars.

The amount of change ΔL(AB) in the distance between AA' and BB' is opposite in direction to the amount of change ΔL(CD) in the distance between CC' and DD', and these distances change according to a predetermined relationship. FIG. 10 shows this change relationship.

Actual situations can be summed up with the following restriction ranges in actual applications (however, the present invention is not limited to the following ranges):

1) L(AB)>L(CD). That is, a short side of the parallelogram of the shutter mechanism is longer than that of the parallelogram of the slit mechanism.

In this arrangement, the short side L(AB) of the parallelogram of the shutter mechanism selects from the range of 20 mm to 150 mm.

The short side L(CD) of the parallelogram of the slit mechanism selects from the range of 20 mm to 140 mm.

2) The short sides of the parallelogram of the shutter mechanism and those of the parallelogram of the slit mechanism are fixed in the form of "crossbars". The range of the distances from the fixing points to the centers of the respective short sides is 0 mm to 50 mm.

3) The angle β defined by each short side of the parallelogram of the shutter mechanism and a corresponding short side of the parallelogram of the slit mechanism is an arbitrary fixed value from 50° to 140°.

The above embodiment is an example to facilitate the understanding of the present invention, and does not limited to the invention. The components and parts disclosed in the above embodiment can therefore be replaced by other parts having the same functions, newly designed, or improved within the spirit and scope of the invention. In addition, any possible combinations of these components and parts are included in the spirit and scope of the invention as long as they have merits similar to those of the embodiment of the invention.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A slit mechanism apparatus comprising:

two slit plates configured to adjust a thickness of X-rays;

two slit link bars which are pivotally supported on two ends of each of the two slit plates to interlock the two slit plates;

two shafts on which the two slit link bars are respectively mounted to rotate the two slit link bars;

two shutter plates configured to block/pass the X-rays; and two shutter link bars which are pivotally supported on two ends of each of the two shutter plates to interlock the two shutter plates and are mounted on the two shafts together with the two slit link bars.

2. The apparatus according to claim 1, wherein the shutter link bar has a length longer than that of the slit link bar.

3. The apparatus according to claim 1, wherein the shutter link bar is fixed to the slit link bar at a predetermined intersection angle.

4. The apparatus according to claim 1, wherein the shutter link bar intersects the slit link bar at an angle selected from a range of 50° to 140°.

5. The apparatus according to claim 1, wherein the shutter link bar intersects the slit link bar at an angle of substantially 90°.

6. The apparatus according to claim 1, wherein the shutter link bar is mounted on the shaft at a predetermined distance from the slit link bar so as to prevent the two slit plates from interfering with the two shutter plates.

7. An X-ray computed tomography apparatus comprising an X-ray tube which generates X-rays, an X-ray detector which detects X-rays transmitted through an object, a rotating mechanism which rotates the X-ray tube together with the X-ray detector around the object, and a slit mechanism apparatus which is provided between the X-ray tube and the object to adjust a width of the X-rays, the slit mechanism apparatus comprising two slit plates configured to adjust a width of X-rays, two slit link bars which are pivotally supported on two ends of each of the two slit plates to interlock the two slit plates, two shafts on which the two slit link bars are respectively mounted to rotate the two slit link bars;

two shutter plates configured to block/pass the X-rays, and two shutter link bars which are pivotally supported on two ends of each of the two shutter plates to interlock the two shutter plates and are mounted on the two shafts together with the two slit link bars.

8. The apparatus according to claim 7, wherein the shutter link bar has a length longer than that of the slit link bar.

9. The apparatus according to claim 7, wherein the shutter link bar is fixed to the slit link bar at a predetermined intersection angle.

10. The apparatus according to claim 7, wherein the shutter link bar intersects the slit link bar at an angle selected from a range of 50° to 140°.

11. The apparatus according to claim 7, wherein the shutter link bar intersects the slit link bar at an angle of substantially 90°.

12. The apparatus according to claim 7, wherein the shutter link bar is mounted on the shaft at a predetermined distance from the slit link bar so as to prevent the two slit plates from interfering with the two shutter plates.

13. A X-rays beam adjusting/blocking apparatus which includes X-rays beam adjustment means comprising an adjustment plate, X-rays blocking means comprising a blocking plate, and switching means and adjusts and blocks a X-rays beam, wherein when the switching means is in a state to block a X-rays beam, the X-rays blocking means blocks X-rays, and when the switching means is in a state to adjust a X-rays beam, a slit which makes a blocking plate of the X-rays blocking means pass a X-rays beam is always larger than a slit which makes an adjustment plate of the X-rays beam adjustment means pass a X-rays beam.

14. The apparatus according to claim 13, wherein the X-rays beam adjustment means comprises two adjustment plates and adjusts an intensity of a X-rays beam by adjusting a slit between the two adjustment plates, and the X-rays blocking means comprises two blocking plates and blocks passage of X-rays by reducing a slit between the two blocking plates to 0.

15. The apparatus according to claim 14, wherein the X-rays blocking means is placed above the X-rays beam adjustment means, the switching means includes two blocking/switching plates and two adjusting/switching plates, and forms two crossbars by installing the two blocking/switching plates and the two adjusting/switching plates so as to make the two blocking/switching plates respectively intersect the two adjusting/switching plates, and two ends of each of the two blocking/switching plates are connected to two ends of a corresponding one of the two blocking plates to form a parallelogram, and two ends of each of the two adjusting/switching plates are connected to two ends of a corresponding one of the two adjustment plates to form another parallelogram.

16. The apparatus according to claim 15, wherein a length of the blocking/switching plate is not less than a length of the adjusting/switching plate.

17. The apparatus according to claim 16, wherein an intersection angle between the blocking/switching plate and the adjusting/switching plate is constant.

18. The apparatus according to claim 17, wherein an intersection angle between the blocking/switching plate and the adjusting/switching plate is 50° to 140°.

19. A CT apparatus including X-ray emission means for emitting X-rays, optical adjustment means for filtering X-rays, a bed on which a patient is placed, and detection means for detecting and X-rays and performing signal processing, further comprising a X-rays beam adjusting/blocking apparatus which includes X-rays beam adjustment means comprising an adjustment plate, X-rays blocking means comprising a blocking plate, and switching means and adjusts and blocks a X-rays beam, the X-rays blocking means blocking X-rays when the switching means is in a state to block a X-rays beam, and a slit which makes a blocking plate of the X-rays blocking means pass a X-rays beam being always larger than a slit which makes an adjustment plate of the X-rays beam adjustment means pass a X-rays beam when the switching means is in a state to adjust a X-rays beam.

20. The apparatus according to claim 19, wherein the X-rays beam adjustment means comprises two adjustment plates and adjusts an intensity of a X-rays beam by adjusting a slit between the two adjustment plates, and the X-rays blocking means comprises two blocking plates and blocks passage of X-rays by reducing a slit between the two blocking plates to 0.

21. The apparatus according to claim 20, wherein the X-rays blocking means is placed above the X-rays beam adjustment means, the switching means includes two blocking/switching plates and two adjusting/switching plates, and forms two crossbars by installing the two blocking/switching plates and the two adjusting/switching plates so as to make the two blocking/switching plates respectively intersect the two adjusting/switching plates, and two ends of each of the two blocking/switching plates are connected to two ends of a corresponding one of the two blocking plates to form a parallelogram, and two ends of each of the two adjusting/switching plates are connected to two ends of a corresponding one of the two adjustment plates to form another parallelogram.

22. The apparatus according to claim 21, wherein a length of the blocking/switching plate is not less than a length of the adjusting/switching plate.

23. The apparatus according to claim 21, wherein an intersection angle between the blocking/switching plate and the adjusting/switching plate is constant.

* * * * *